US005169467A

United States Patent [19]

Komiya et al.

[11] Patent Number: 5,169,467

[45] Date of Patent: Dec. 8, 1992

[54] INK OCCLUSION MATERIAL FOR WRITING UTENSILS

[75] Inventors: Kunihiko Komiya, Toyonaka; Kenji Arai, Nara; Toshihiro Yamamoto, Hofu, all of Japan

[73] Assignee: Kanebo, Ltd., Japan

[21] Appl. No.: 569,949

[22] Filed: Sep. 27, 1990

Related U.S. Application Data

[62] Division of Ser. No. 376,760, Jul. 7, 1989, Pat. No. 4,970,854.

[30] Foreign Application Priority Data

Jul. 11, 1988 [JP] Japan ..... 63-173451

[51] Int. Cl.[5] ..... D04H 3/08

[52] U.S. Cl. ..... 156/180; 57/254; 57/255; 428/369; 428/394; 428/395

[58] Field of Search ..... 152/180, 167; 428/394, 428/395, 369; 57/297, 295, 251-258; 401/198, 199

[56] References Cited

U.S. PATENT DOCUMENTS

| | | | |
|---|---|---|---|
| 3,467,564 | 9/1969 | Daugherty et al. | 156/180 |
| 3,558,392 | 1/1971 | Goodenow et al. | 156/180 |
| 4,104,781 | 8/1978 | Midorikawa | 401/198 |
| 4,118,529 | 10/1978 | Nakagawa et al. | 428/399 |
| 4,402,178 | 9/1983 | Negishi et al. | 57/208 |
| 4,517,715 | 5/1985 | Yoshida et al. | 57/203 |
| 4,523,428 | 6/1985 | Negishi et al. | 57/284 |
| 4,729,215 | 3/1988 | Sato et al. | 57/255 |

*Primary Examiner*—Michael W. Ball
*Assistant Examiner*—Daniel J. Stemmer
*Attorney, Agent, or Firm*—Morgan & Finnegan

[57] ABSTRACT

According to the present invention, the ink occlusion material for writing utensils comprises a fiber bundle of a mixture of (a) and acrylic synthetic fiber and (b) at least one hydrophobic fiber selected from the group consisting of polyester fibers and polypropylene fibers in a weight ration of 20 to 70:80 to 30. The two fibers are drawn so as to show a sea-island form in the cross-section of the fiber bundle, spot-adhered by the partial melt-adhesion of the acrylic synthetic fiber, and the fiber bundle is twisted at a rate of 1 to 30 T/M.

1 Claim, 1 Drawing Sheet

PRIOR ART

INK OCCLUSION MATERIAL FOR WRITING UTENSILS

This is a divisional of co-pending application Ser. No. 07/376,760 filed Jul. 7. 1989 now U.S. Pat. No. 4,970,854.

BACKGROUND OF THE INVENTION

The present invention relates to an ink occlusion material for writing utensils, particularly to an aqueous-ink occlusion material and a method for the preparation thereof.

Previously known ink occlusion material for writing utensils, are prepared by (a) impregnating a precondensate of a thermosetting resin such as melamine, epoxy or phenol resin in a fiber bundle of synthetic fibers such as polyester, nylon, acrylic, vinylon or polyethylene fibers, and (b) compressing and heating the fiber bundle to adhere the synthetic fibers in order to form the fiber bundles into a shape. However, by using thermosetting resin in the occlusion material, it is necessary to smoothly apply a liquid such as an ink for writing utensils. As a result, the thermosetting resin does not adhere uniformly to the fiber bundle resulting in the capillary structure useful for ink flow and ink occlusion becoming incomplete and the fluctuation of ink flow increasing.

To improve such disadvantages, Japanese Patent Publication No. 37571 of 1975 discloses a method in which a mixed sliver of a plurality of fibers having different melting points is covered with a resin film having approximately the same melting point as them in order to effect hot melt adhesion. However, the disadvantage of this method is that the ink utilization ratio is lowered as the resin absorbs ink.

As an alternative method, Japanese Patent Publication No. 16963 of 1970 discloses a method in which the fibers are combined parallel in the axis direction. The resulting continuous fiber bundle is (a) treated with an adhesive solution, (b) squeezed and (c) the solvent is removed by drying in order to adhere and fix the fibers and (d) finally the periphery of the fiber bundle is covered with a polymer film in order to prepare an ink conclusion material. However, the disadvantage of this method is that the step of adhering the film at the overlapping portion after covering the bundle with the polymer film cannot be speed up, the percent defect is high and the resulting continuous fiber bundle is not economical.

Previously, in Japanese Patent Laid-open Publication No. 199698 of 1982, the present inventors proposed a method in which crimped acrylic fibers was combined parallel to the fiber axis direction and an organic solvent, which can dissolve the fibers applied is on the resulting fiber bundle. The bundle is heated to melt-adhere at least a portion of the fibers. However, this method, which the fibers are combined parallel to the fiber axis direction, has the disadvantage that the fibers partially fall out during the squeezing procedure involving th organic solvent and during the drying procedure. Moreover, the adhered spots are few unless the heating is carried out under compression. On the other hand, as the acrylic fiber becomes more hydrophilic such as polyester fiber, polyethylene fiber and polypropylene fiber, it retains more ink when an aqueous ink is used. Thus, the ink utilization ratio decreases.

Furthermore, Japanese Laid-Open Patent Publication No. 60774 of 1986 discloses a method in which a fiber of low hydrophilic nature such as polyester fiber is mixed in the fiber bundle in order to solve the problem of the above-mentioned Japanese Laid-Open Patent Publication No. 199698 of 1982. However, when polyester fiber, etc. is mixed uniformly, the ink utilization ratio can be somewhat improved but the ink retainability is lowed in order to get an enough ink utilization. However, the problem of fiber escape occurs.

An object of the present invention is to provide an ink occlusion material which has the same ink retention as in the case of using an acrylic fiber alone, while showing a high ink utilization ratio, giving no problem of fiber escape, which then can be easily handled. Another object of the present invention is to provide a easy method for the preparation of such an easily handled ink occlusion material for writing utensils at a commercial scale and at a low price.

SUMMARY OF THE INVENTION

According to the present invention, the ink occlusion material for writing utensils comprises a fiber bundle of a mixture of (a) an acrylic synthetic fiber and (b) at least one hydrophobic fiber selected from the group consisting of polyester fibers and polypropylene fibers in a weight ratio of 20 to 70:80 to 30. The two fibers are drawn so as to show a sea-islan form in the cross-section of the fiber bundle, and are spot-adhered by the partial melt adhesion of the acrylic synthetic fiber. Finally, the fiber bundle is twisted at a rate of 1 to 30 T/M.

DETAILED DESCRIPTION OF THE INVENTION

The inventors have found that the expected object can be attained by combining in parallel acrylic fibers and polyester fibers or others in a specified sliver form to give a fiber bundle and providing proper adhesion and twist to exert synergistic effect of the two fibers.

In the ink occlusion material according to the present invention, the acrylic fibers, which are high the ink retainability, and the hydrophobic fibers which enhance the ink utilization ratio, are scattered in the sea-island form as fiber groups of proper thickness, slivers, in the fiber bundle. The result is sufficient ink retainability can be attained and, at the same time, ink can flow out smoothly through the hydrophobic fiber groups adjacent to the acrylic fiber groups to ensure the ink utilization.

In the present invention, the sea-island form is defined as one of the acrylic synthetic fiber and the above-mentioned hydrophobic fiber appear in a sea-island form such that the fiber group has 3 to 20 fibers in the cross section of the fiber bundle, which constitutes the ink occlusion material.

In the fiber bundle having such sea-island cross section, the spot-melt adhesion of acrylic fiber can be properly attained. Since the above spot-melt adhesion, according to the present invention, is carried out in a condition so that the fiber bundle is twisted at a rate of 1 to 30 T/M, no escape of fibers occur during both the cutting of the fiber bundle and insertion to the utensil. Therefore, a high quality product results.

The ink occlusion material of the present invention can be prepared by a procedure in which: (a) a crimped acrylic fiber is mixed with a crimped hydrophobic fiber selected from the group consisting of polyester fiber and polypropylene fiber in a weight ratio of 20 to 70 : 80 to 30; (b) the mixed fiber is combined parallel to the fiber axis direction so that the two types of fiber show a sea-island form in the cross section of the bundle; (c) the bundle is twisted at a rate of 1 to 30 T/M; (d) an organic solvent, which can dissolve the acrylic fiber, is applied on the resulting fiber bundle; (e) the bundle is dried; and (f) heat treated at a temperature not lower than the activation temperature of the organic solvent to melt-adhere a portion of the fibers.

Any commercially available crimped acrylic fiber can be used in the present invention. For example, a crimped acrylic fiber that can be used is one prepared by a procedure, in which an acrylic polymer prepared by a copolymerization of a monomer composition containing 50 weight % or more (preferably 80 weight or more) of acrylonitrile and, if required, further containing acrylic acid derivatives such as methyl acrylate, methyl methacrylate or the like, or a sulfonic acid group containing monomer, is spun and crimped.

Further, any commercially available polyester fiber can be used in the present invention. It is preferred to use 5 to 30 weight % of a low-melting polyester fiber having a melting point of 100 to 150° C. in combination with a common polyester fiber.

As the polypropylene fiber, any commercially available polypropylene fiber can also be used. It is preferred to use 5 to 30 weight % of a low-melting polypropylene fiber having a melting point of 100 to 150° C. in combination with a general polypropylene fiber.

The acrylic fiber may be used to account for 20 to 70 weight % based on the total amount of the fiber bundle. It is especially preferred to account for 40 to 70 weight %.

Although polyester fiber and polypropylene fiber may be used in combination as the hydrophobic fibers, it is not necessary to use a combination. Usually, one of them issued together with acrylic fiber. The preferred number of crimp of these fibers is 5 to 20 per inch, preferably 6 to 14 per inch. The fitness is usually 1 to 20 deniers, preferably 20 to 10 deniers.

It is required that the ink occlusion material prepared, according to the present invention, has an almost uniform capillary structure so that the distance between each fibers is almost uniformly distributed without too large or too small a distance between each fiber. In addition, tight adhesion between fibers must be avoided.

When a fiber with no crimp is used, partial tight adhesion tends to occur between fibers and proper capillary distance cannot be formed. Thus, a crimped fiber should be used. When a cramped fiber is used, tight adhesion between fibers is difficult to be caused. Therefore, a product of excellent ink occlusion and high ink fluidity can be obtained.

The crimp may be provided physically or mechanically in the later stage of a spinning process, and it may be structurally obtained by using the latent shrinkage force of the fiber.

In the present invention, cut stock of 30 to 200 mm long is worsted and drawn and then combined in parallel to the axis direction and the sliver thus formed is combined for use. The form of worsting and drawing for sliver formation that maybe used is a short spinning such as 2 inch spinning, 3 inch spinning or the link and a long spinning such as worsted spinning, semiworsted spinning or the like can be used in accordance with the fiber length. In general, a worsted sliver prepared by using fibers of 75 to 130 mm long is most preferred.

The fiber bundle is formed with such slivers. The grain of the sliver is properly decided according to the type of the objective ink occlusion material and is usually 1 to 100 g/m.

According to the present invention, the slivers thus prepared are combined in parallel to form a fiber bundle having a cross section of sea-island form. For the purpose, it is preferred that plural slivers of acrylic fiber and plural slivers of hydrophobic fiber are used inc combination, preferably in a ratio of 2~6:2~6 and are drawn in as a small doubling times as not more than 3 times, preferably once or twice.

Then, a twist of 1 to 30 T/M is provided to the fiber bundle thus prepared. The twist is preferably 3 to 20 T/M. A twist less than 1 T/M causes escape of fiber in the squeeze guide of the organic solvent bath in the succeeding process and in the drying process which decreases the melt adhesion points, while a twist more than 30 T/M increases distortion of the product and lowers ink occlusion.

The slivers thus prepared are combined in parallel and twisted. Then, an organic solvent, which has a dissolution ability for the acrylic fiber mainly constituting the resultant fiber bundle, is applied between the fibers of the bundle by impregnation and the like to dissolve the fiber partially and to adhere it to form a shape.

As the organic solvents used in the present invention, there are exemplified many compounds such as amide type, nitrile type, sulfone type, sulfoxide type, nitro type and carbonate type compounds. For example, the amide type compounds include dimethylformamide, dimethylaceamide, etc., the nitrile compounds including succinonitrile, malononitrile, etc., the sulfone compounds include tetramethylene sulfone, ethyl methyl sulfone, etc., the sulfoxide compounds include dimethyl sulfoxide, the nitro compounds include nitromethane, the carbonate compounds include $\tau$-butyrolactone, ethylene carbonate, etc.. These solvents may be used as a solution such as a mixed solution, an aqueous solution or an acetone comprising solution.

The dissolution behavior of these solvents on acrylic fiber are not necessarily the same for each other and are affected by their diverse chemical characteristics, by their diverse temperature dependence, and by their diverse solubilization temperatures. Accordingly, any of these organic solvents can be used in the present invention if a proper condition is selected. However, it is essential that the chemical characteristics, especially the temperature dependence of the organic solvent on acrylic fiber, is taken in consideration and the temperature of the impregnation bath is selected so that the fiber does not swell in that temperature range.

Accordingly, for the fixing and drying after impregnation and squeezing, the fiber is exposed to an atmosphere of higher temperature. A temperature at which the organic solvent starts to swell and dissolve the fiber shall be selected as the drying and fixing temperature.

As the solvent used in the present invention, tetramethylene sulfone is especially preferred from a workability and the product quality stand point.

The amount of the organic solvent used should be appropriately decided according to the hardness of the objective ink occlusion material. The hardness relates to the size of the utensil, that is the thickness of the occlusion material, the type of connection to the pen point, or the viscosity and fluidity of the ink used.

The pick-up of the organic solvent on the fiber is selected usually from the range of 1 to 30 weight % according to the requirement of the hardness. The range of 7 to 5 weight % is most preferred.

In the case the organic solvent is used as a solution of an organic solvent, the concentration of the organic solvent in the solution can be properly selected according to the squeezing rate of the succeeding squeezing equipment. If required, the organic solvent can be adjusted so that the amount adhered on the fiber after squeeze becomes 1 to 30 weight %, preferably 7 to 15 weight % based on the fiber weight.

The fiber bundle applied with organic solvent is then heated and dried and further heat treated at a temperature higher than the activation temperature of the organic solvent and thus melt-adhered. The heating and drying can be made at a relatively low temperature. For example, it may be 80 to 100° C. in the case of an acetone/tetramethylene sulfone (85/15 weight/weight) solution. Then, the bundle is heat-treated to spot adhere between fibers. This treatment is usually carried out in as a short contact period as 0.05 to 0.3 sec. at a temperature in the range of 200 to 350° C. A contact period of 0.1 to 0.2 sec. and a treating temperature of 250 to 280° C. ar preferred. In the case of the above-mentioned example, the desired occlusion material can be prepared by passing it through an atmosphere at 200° C.

On the other hand, neither the polyester fiber nor the polypropylene fiber melt-adheres to the acrylic fiber, but they are present within the spot-adhered net of the acrylic fibers. If a higher hardness is required, it is preferred to use a low-melting polyester fiber and/or a low-melting polypropylene copolymer fiber in combination and, in this case, it is preferred that each polyester fibers and polypropylene fibers are spot-adhered by a heat treatment process and then the organic solvent is evaporated.

When the ink occlusion material is inserted in the cylindrical main body of the utensil, the hard coated layer on the periphery of the resultant in occlusion material forms a small space between the main body of the utensil and the ink occlusion material. It is favorable that the space serves as the path for air to be replaced by the injected ink in the ink-injecting process and also as the path for air to be replaced by the ink flowing on the paper in the writing with the completed utensil.

An ink occlusion material having an equilibrium moisture regain of 0.75 to 1.6% at 20° C. and 95% RH can be prepared according to the present invention. An equilibrium moisture regain of higher than 1.6% improves the ink retention but decreases the ink utility markedly, while that of lower than 0.75 % lowers the ink retention. Thus, both are found to be unsuitable as the ink occlusion material.

DETAILED DESCRIPTION OF THE PREFERRED EMBODIMENTS

The present invention will be illustrated by the following Examples.

EXAMPLE 1

A bias-cut acrylic synthetic fiber having a fineness of deniers and a cut length of 102 mm was carded and gilled or drawn in the same manner as in a usual worsted spinning process to prepare a sliver (A) of 40 g.m. In the same manner, a bias-cut polyester fiber having a fineness of 3 deniers and a cut length of 102 mm was carded and gilled or drawn to prepare a sliver (B) of 40 g/m.

The slivers (A) and (B) were mixed together by gilling or drawing as shown in Table 1. The resulting sliver of 40 g/m was twisted (5 times/m), immersed in a 20% acetone solution of tetramethylene sulfone, squeezed with a rubber roller (to 50% pick-up), passed through an air circulating oven at 90° C. to remove acetone, and then passed through a far-infrared drier held at 200° C. to remove tetramethylene sulfone and, at the same time, to spot-adhere the acrylic synthetic fibers. Finally, the bundle was passed through a cutter to prepare a cylindrical ink occlusion material of 100 mm long. It was inserted in a cylindrical body of a writing utensil (inner diameter of 16 mm). The ink used comprised aqueous pigments.

Twelve fiber bundles were prepared as shown in Table 1 by varying the sliver mixing condition, that is, the number of slivers (A) and (B) or the doubling time, and the number of sliver mixing processes.

These twelve fiber bundles were treated by the above-mentioned procedure to prepare a cylindrical ink occlusion material and inserted in the body of a writing utensil. The properties of the obtained writing utensils, such as ink retainability and ink utilization ratio, were examined. The results are shown in Table 1.

TABLE 1

| | Drawing | | | | | |
|---|---|---|---|---|---|---|
| No. | Number of silver (A) Acrylic Fiber | Number of silver (B) Polyester Fiber | Number of process | State of silver mixture*2 | Ink retainability*3 | Ink utilization ration*4 |
| 1 | 4 | 4 | 1 | S-I | ◎ | 88 |
| 2 | 4 | 4 | 2 | S-I | ◎ | 85 |
| 3*1 | 4 | 4 | 3 | Ap. Un. | ◎ | 79 |
| 4*1 | 4 | 4 | 5 | Unif. | ◎ | 75 |
| 5*1 | 8 | 0 | 2 | Unif. | ◎ | 70 |
| 6*1 | 7 | 1 | 2 | S-I | ◎ | 73 |
| 7*1 | 6 | 2 | 2 | S-I | ◎ | 78 |
| 8 | 5 | 3 | 2 | S-I | ◎ | 81 |
| 9 | 3 | 5 | 2 | S-I | ◎ | 83 |
| 10 | 2 | 6 | 2 | S-I | ○ | 83 |
| 11*1 | 1 | 7 | 2 | S-I | Δ | 86 |

TABLE 1-continued

| No. | Drawing: Number of silver (A) Acrylic Fiber | Drawing: Number of silver (B) Polyester Fiber | Drawing: Number of process | State of silver mixture*2 | Ink retainability*3 | Ink utilization ration*4 |
|---|---|---|---|---|---|---|
| 12*1 | 0 | 8 | 2 | Unif. | X | 88 |

Figure 1:
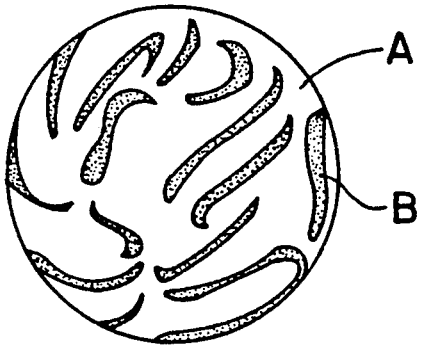
FIG. 1 shows a cross section of the fiber bundle No. 8 in Example 1 in which two types of fiber give a sea-island form.
Figure 2:
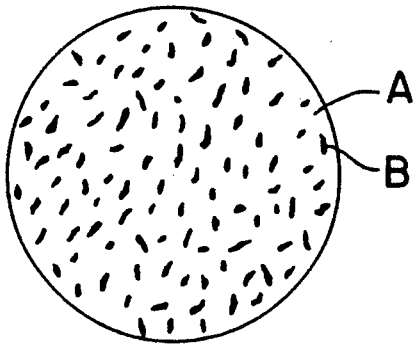
FIG. 2 shows a cross section of the fiber bundle No. 3 in Example 1 in which two types of fiber are almost uniformly mixed.
Figure 3:
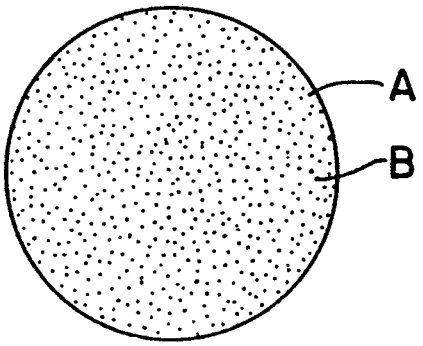
PRIOR ART FIG. 3
FIG. 3 shows a cross section of the fiber bundle No. 4 in Example 1 in which two types of fiber are uniformly mixed.

*1Comparative Example
*2State of the cross section of fiber bundle observed by dying test.
S-I: Sea-island form. It means a condition in which silver (A) or silver (B) can be seen as 3-20 fiber groups by the dying test.
Ap. Un.: Approximately uniform. It means a condition in which some unevenness is observed in the mixing of fibers but no group of fibers showing clear island form is present.
Unif.: Uniform. It means a condition in which the fibers are uniformly mixed to unity.
As a reference, the cross sections of fiber bundles of Nos. 3, 4 and 8 are shown in FIGS. 1 to 3.
*3Ink retainability: The pen is capped and held for 30 days in a state of directing the pen point downward and then ink leakage into the cap is examined.
◎ No leakage at all
○ Slight leakage
Δ Low leakage
X High leakage
*4Ink utilization ratio:

$$\text{Ink utilization ratio} = \frac{W_2 - W_1}{W_0} \times 100$$

where $W_1$(g): Weight of the pen when it becomes scratchy on running.
$W_2$(g): Weight of the pen before running.
$W_0$(g): Weight of the ink filled.

As shown in Table 1, Test Nos. 1, 2 and 6-8 in which number of sliver (A) is equal to or greater than the number of sliver (B), the polyester fibers of sliver (B) forms the fiber groups which look like islands in the sea of sliver (A). In Test Nos. 9-11 in which the number of sliver (A) is less than the number of sliver (B), acrylic fibers of sliver (A) form the fiber groups which look like islands in the sea of sliver (B).

From the result of Table 1, it is shown that the products prepared by using two types of fiber in a ratio specified by the present invention to give sea-island form cross section of fiber bundle (Nos. 1, 2 and 8 to 10) are excellent in the ink retainability and ink utilization ratio. However, the products with a deviated mixing ratio of fibers (Nos. 6 and 11) or the products in which the fibers are uniformly mixed (Nos. 3 and 4) give no desired result.

EXAMPLE 2

A bias-cut acrylic synthetic fiber having a fineness of 3 deniers and a cut length of 102 mm was carded and gilled or drawn in a same manner as in the usual worsted spinning to prepare a sliver (a) of 40 g/m. In a same manner, a mixed stock of a bias-cut polyester fiber having a fineness of 3 deniers and a cut length of 102 mm and 80.2 weight % of a low-melting polyester fiber having the same denier and the same cut length as above was carded and gilled or drawn to prepare a sliver (b) of 40 g/m.

5 of the sliver (a) and 3 of the sliver (B) were mixed together twice by gilling or drawing. The resulting sliver of 40 g/m was twisted as shown in Table 2, immersed in a 20% acetone solution of tetramethylene sulfone, squeezed with a rubber roller (to 50% pick-up), passed through an air circulating oven at 90° C. to remove acetone, and then passed through a far-infrared drier held at 200° C. to remove tetramethylene sulfone and at the same time to spot adhere the acrylic synthetic fibers and the polyester fibers. Finally, the bundle was passed through a cutter to prepare a cylindrical ink occlusion material of 100 mm long. It was inserted in a cylindrical main body of an utensil (inner diameter of 16 mm) and the ink retention was tested using a aqueous ink. The results are shown in Table 2 together with the frequency of fiber escape from the sliver (frequency of troubling) in the series of processes after twisted.

TABLE 2

| No. | Number of twist T/M | Frequency of troubling times/3 hrs. | Ink*2 retainability |
|---|---|---|---|
| 13*1 | 0 | 10 | ◎ |
| 14 | 1 | 1 | ◎ |
| 15 | 5 | 0 | ◎ |
| 16 | 10 | 0 | ◎ |
| 17 | 15 | 0 | ○ |
| 18 | 30 | 0 | ○ |
| 19*1 | 60 | 0 | x |

*1Comparative Example
*2Measured by the same method as in Table 1.

From the results shown in Table 2, it can be found that the products twisted properly according to the present invention shows no fiber escape from the sliver and can be easily handled and is excellent in ink retention.

As described above, the present invention can provide a stable ink occlusion material which forms no trouble such as fiber escape from the sliver and is excellent in both ink retainability and ink utilization ration.

Further, since the ink occlusion material of the present invention is prepared by swelling and/or dissolving a part of the fibers to spot-adhere them with no use of a thermosetting resin, no unreacted residue of either a curing agent, a treating agent or the like deposits on the fibers. Therefore, adhesion between the fibers is uniform. Furthermore, neither deterioration of the ink due to chemical reaction nor poor writing caused by the clogging of ink due to the unevenness of pores as the result of uneven adhesion occurs. Therefore, the liquid ink can be stably supplied.

What is claimed is:

1. A method for the preparation of an ink occlusion material for writing utensils, in which (a) crimped acrylic fibers are mixed with crimped hydrophobic fibers selected from the group consisting of polyester fibers and polypropylene fibers in a weight ratio of 20 to 70:80 to 30; (b) the mixed fibers are combined in parallel to the fiber axis direction so that the two type fibers are distributed to form in the cross section of the bundle a sea of one type of fibers with islands of the other type of fibers such that the islands are distributed nonuniformly in the sea (c) the bundle is twisted at a rate of 1 to 30 T/M; (d) an organic solvent, which can dissolve said acrylic fibers is applied on the resultant fiber bundle; and (e) the bundle is dried and then heat-treated at a temperature not lower than the activation temperature of said organic solvent to melt-adhere a portion of said acrylic fibers.

* * * * *